United States Patent [19]

Röck et al.

[11] Patent Number: 4,872,735

[45] Date of Patent: Oct. 10, 1989

[54] DRAWER INCLUDING ROLLER CARRIER CONNECTING SIDE WALLS TO REAR MEMBER

[75] Inventors: Erich Röck; Josef Brunner, both of Höchst, Austria

[73] Assignee: Julius Blum Gesellschaft M.B.H., Höchst, Austria

[21] Appl. No.: 68,335

[22] Filed: Jul. 1, 1987

[30] Foreign Application Priority Data

Jul. 14, 1986 [AT] Austria ..... 1898/86

[51] Int. Cl.[4] ..... A47B 88/00

[52] U.S. Cl. ..... 312/342; 312/345; 312/330.1; 384/19

[58] Field of Search ..... 312/330 R, 330 SM, 342, 312/345, 341 R; 384/19, 20, 22, 23

[56] References Cited

U.S. PATENT DOCUMENTS

| | | | |
|---|---|---|---|
| 1,905,857 | 4/1933 | Hamilton | 312/330 R |
| 1,936,733 | 11/1933 | Richardson | 312/330 R |
| 2,118,525 | 5/1938 | Richardson | 312/330 R X |
| 4,304,449 | 12/1981 | Litchfield et al. | 384/19 X |
| 4,549,774 | 10/1985 | Bessinger et al. | 384/19 |
| 4,601,523 | 7/1986 | Wenzlick et al. | 312/330 R |
| 4,612,572 | 10/1986 | Nelson | 384/19 X |
| 4,645,359 | 2/1987 | Nelson | 384/19 |
| 4,671,581 | 6/1987 | Faust et al. | 312/330 R |

FOREIGN PATENT DOCUMENTS

| | | | |
|---|---|---|---|
| 124059 | 11/1984 | European Pat. Off. | 312/330 R |
| 3316542 | 11/1984 | Fed. Rep. of Germany | 312/330 SM |
| 270021 | 11/1950 | Switzerland | 312/330 R |
| 1341399 | 12/1973 | United Kingdom | 312/330 R |

*Primary Examiner*—Peter A. Aschenbrenner
*Assistant Examiner*—Thomas A. Rendos
*Attorney, Agent, or Firm*—Wenderoth, Lind & Ponack

[57] ABSTRACT

A drawer includes two metal frames, a front member, a rear wall and a bottom member. At each side at the rear of the drawer there is arranged one runner roller for a pull-out guide and which is mounted on a separate roller carrier. A flange of the roller carrier, the height of which corresponds to the height of the drawer frame and the width of which corresponds to the thickness of the rear wall, extends between the side edge of the rear wall and the drawer frame and is laterally adapted to the contour of the drawer frame.

12 Claims, 4 Drawing Sheets

DRAWER INCLUDING ROLLER CARRIER CONNECTING SIDE WALLS TO REAR MEMBER

FIELD AND BACKGROUND OF THE INVENTION

The invention relates to a drawer comprising two metal drawer frames, a front member, a rear wall and a bottom member. At each side at the rear of the drawer is arranged one runner roller for a pull-out guide and mounted on a separate roller carrier which is connected with the respective drawer frame.

In addition to drawers which are made as an integral piece of plastics material and to the well-known drawers which are made of wood, there have come into use drawers including frames to each of which the runner roller for the pull-out guide is directly fastened.

In such arrangements the drawer frame frequently replaces the pull-out rail of a pull-out guide assembly, the drawer frame having a running flange for the runner roller at the side of the body of the piece of furniture. To be able to take up occurring stresses, in particular in the of mounting the runner roller, such drawer frames have to be relatively strong and are therefore generally made of sheet steel.

Furthermore, drawer frames of extrudable materials, for example of plastic material or aluminum, are known. They can be injection moulded or extruded in any desired form.

SUMMARY OF THE INVENTION

It is the object of the invention to provide an improved drawer in such a manner that assembling of the rear wall of the drawer and the drawer frames is facilitated.

According to the invention this is achieved in that a flange of the roller carrier, the height of which corresponds to the height of the drawer frame and the width of which corresponds to the thickness of the rear wall, extends between the end edge of the rear wall and the respective drawer frame, and that the flange is laterally adapted to the contour of the drawer frame.

According to the invention the ends of the rear wall of the drawer can be cut straight. Adaptation to the contour of the inner side of the drawer frame is otained by the roller carriers.

It is advantageously provided that the roller carriers cover the rear ends of the drawer frames. Consequently the drawer frames can be manufactured as extruded profiles. Only when the depth of the drawer has been set, parts of the extruded profiles of suitable lengths are cut. A special end member at the rear end of the drawer frame is not necessary since such an end member is formed by the roller carriers. At the frontside, the drawer frames are covered by the front member of the drawer. It should be noted that such drawer frames are generally doublewalled to obtain necessary rigidity.

An embodiment of the invention provides that the lower side of the flange is provided laterally with a rounded portion which snugly abuts at a lip of the drawer frame which covers the edge of the bottom of the drawer. The tall edge of the flange of the roller carrier may be provided with a concave rounded portion. This arrangement facilitates cleaning of the drawer.

It is advantageously provided that the roller carriers are of zinc-die casting or steel, whereas the drawer frames are of aluminum.

An embodiment of the invention provides that the rear wall of the drawer is fastened to the roller carriers. Thus the roller carriers function additionally as connecting members between the drawer frames and the rear wall. A preferred embodiment provides that each roller carrier has a flange which extends beyond the drawer frame and carries a drawer rail.

It is advantageously provided that the runner rollers are in alignment with the drawer frames so that the runner rollers are located directly behind flanges of the drawer frames which serve as running flanges for the runner rollers at the side of the furniture body.

BRIEF DESCRIPTION OF THE DRAWINGS

In the following two embodiments of the invention will be described in more detail with reference to the accompanying drawings in which.

DESCRIPTION OF THE PREFERRED EMBODIMENTS

Figure 1:
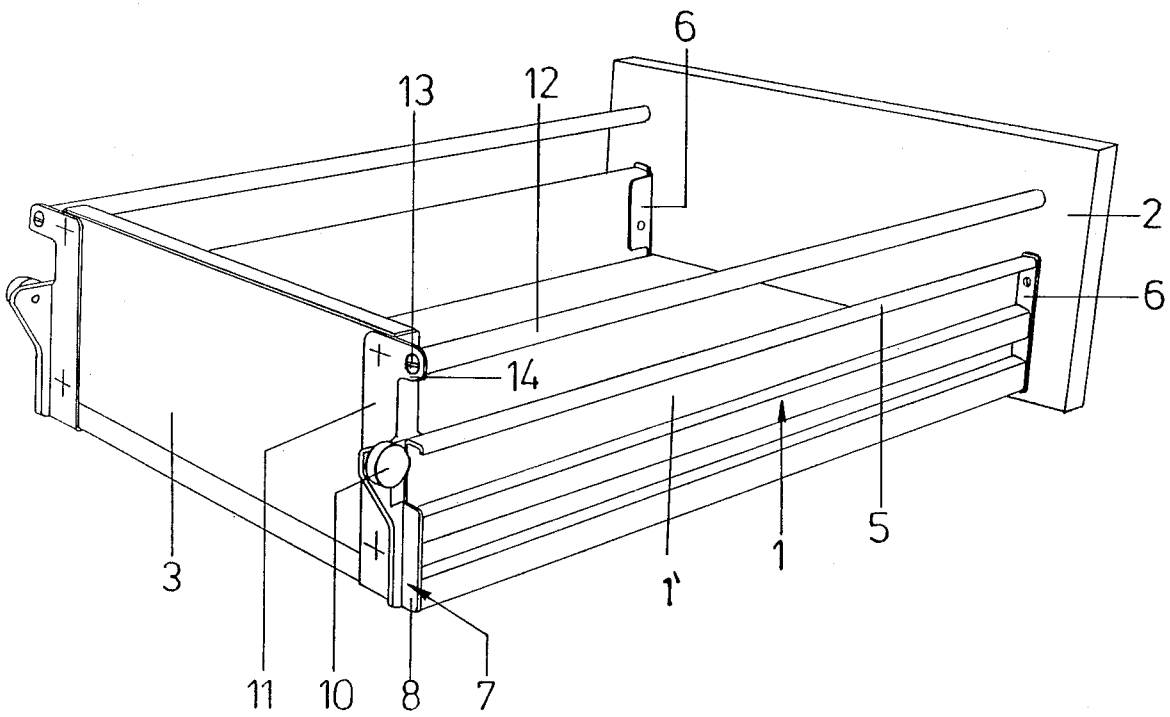
FIG. 1 is a perspective view of a drawer according to one embodiment of the invention.

The main parts of the drawer according to the invention are two drawer side walls or frames 1, a front member 2, a rear wall 3 and a bottom member of the drawer.

The drawer frames 1 are in both embodiments of extruded aluminum and are double-walled including an inner wall 1' and an outer wall 1''. The inner wall 1' is higher than the outer wall 1'' and continues at the upper edge in a flange which forms a running flange 5 for a runner roller, which is at the side of the body of an article of furniture, of a pull-out guide assembly.

The furniture parts at the side of the body are not shown because they are not directly related to the present invention.

The front member 2 is connected with the drawer frames 1 by means of holding members 6.

A roller carrier 7 is arranged at the rear end of each drawer frame 1. In the illustrated arrangement the roller carriers 7 are riveted to the drawer frames 1.

Each roller carrier 7 includes a flange 8 which covers the rear end of the respective drawer frame 1.

A flange 9 carries a runner roller 10 and is aligned vertically to flange 8. In this arrangement the runner roller is in alignment with the drawer frame 1, i.e. arranged directly behind the running flange 5.

Each roller carriers 7 includes a further flange 11 to which the rear wall 3 is attached.

Figure 2:
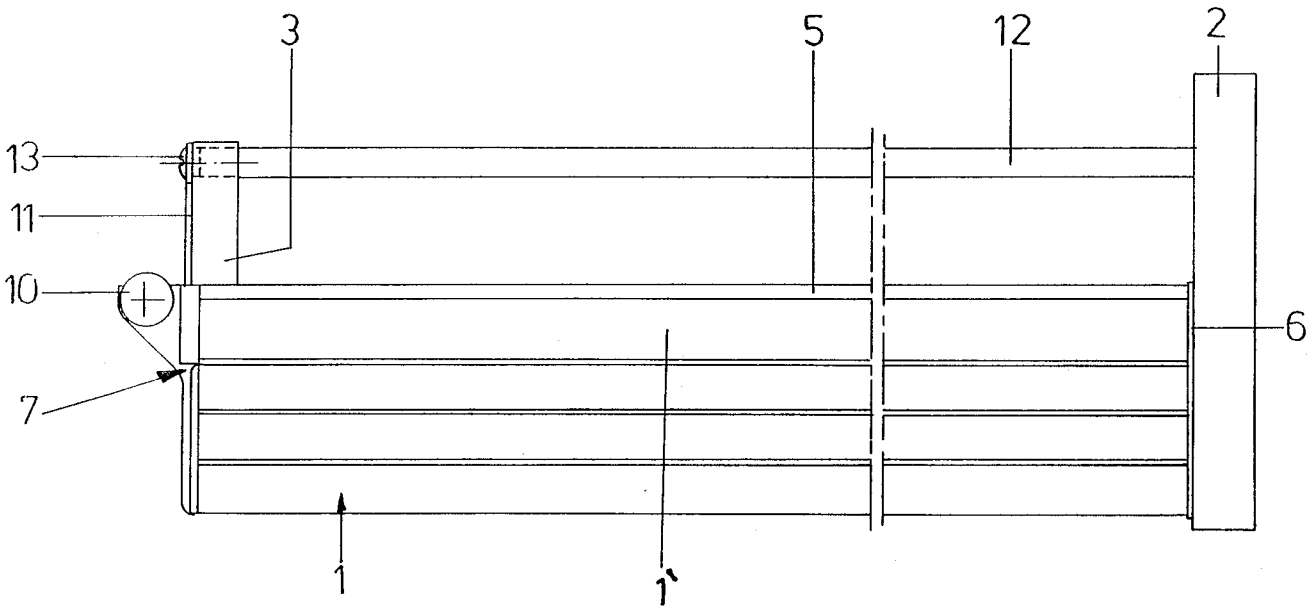
FIG. 2 is a side view thereof.
Figure 3:
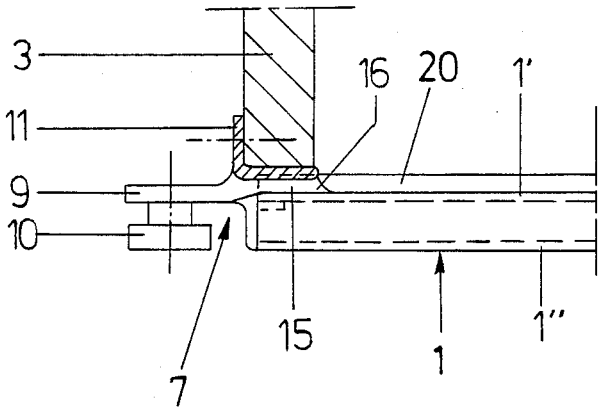
FIG. 3 is a horizontal sectional view of a corner connection with roller carriers.

In the embodiment according to FIGS. 1 to 3, the flange 11 is extended beyond the height of the drawer frame 1 and carries a rail 12. Rail 12 is connected to an angled portion 14 of the flange 11 by means of a screw 13, for example.

In the region of the drawer frame 1, the roller carrier 7 is of cross-shaped configuration and comprises a flange 15 projecting between the drawer frame 1 and the rear wall 3, as particularly shown in FIG. 3. The width, or dimension in a direction parallel to the longitudinal dimension of the drawer frame 1, of the flange 15 corresponds to the thickness of the rear wall 3.

In the embodiment according to FIGS. 1 to 3 the edge of flange 15 which extends into the drawer is provided with a rounded protion 16 which passes continuously from the rear wall 3 to the drawer frame 1.

Figure 4:
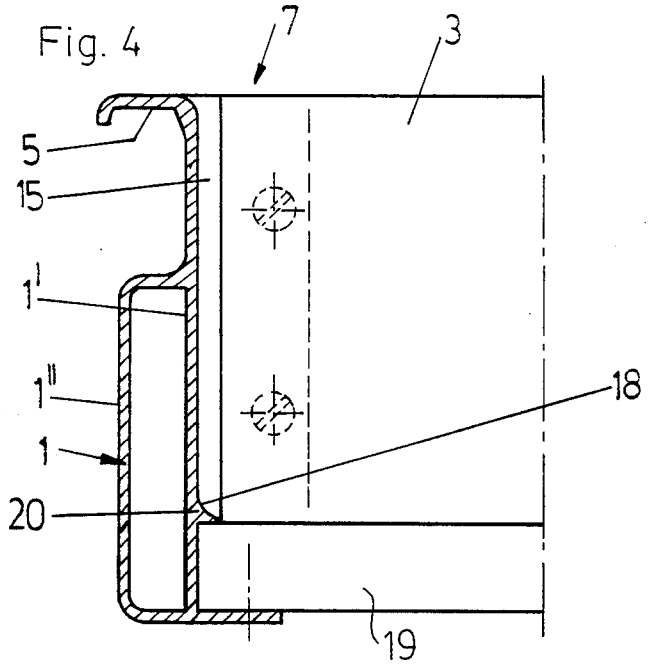
FIG. 4 is a vertical sectional view of a drawer frame of a further embodiment.
Figure 5:
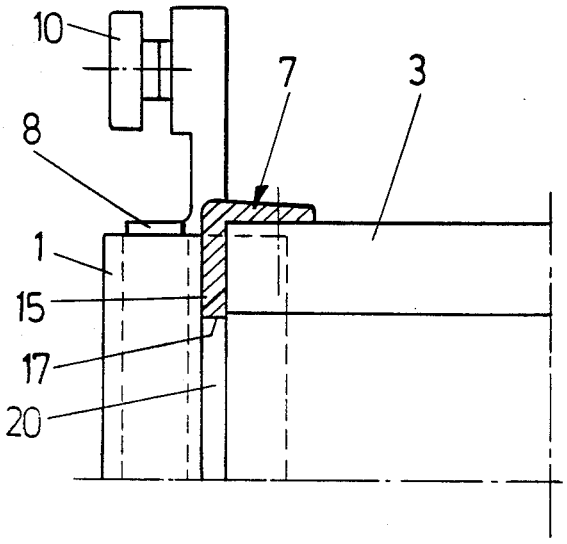
FIG. 5 is a horizontal sectional view of the corner connection of such embodiment.

In the embodiment according to FIGS. 4 and 5, the flange 15 has a planar front face 17. At the lower end the flange 15 is laterally provided with a rounded portion 18 which adapts flange 15 to the contour of the inner side of the drawer frame 1. The drawer frame in this region is defined by longitudinally extending projection in the form of a lip 20 covering the edge of the bottom 19 of the drawer. Hence, the rear wall of the drawer can be cut straight without consideration of the contour of the inner side of the drawer frame 1. The necessary jointless adaptation of the rear wall 3 to the drawer frame 1 is obtained by the roller carrier 7 and its flange 15.

The roller carriers 7 are multi-function parts, i.e. they serve not only for mounting the runner rollers 10, but they also are connecting elements between the drawer frames 1 and the rear wall 3 as well as carrier members for the drawer rails 12.

What is claimed is:

1. In a drawer including two side walls, a front member, a rear member, and a bottom member, the improvement comprising:

each said side wall including a longitudinally extending projection directed inwardly of the drawer;

a separate roller carrier connected to the rear end of each said side wall, each said roller carrier having mounted thereon a respective roller; and each said roller carrier including a forwardly extending flange positioned between the respective side edge of said rear member and the respective said side wall, said flange having a dimension in a direction parallel to the longitudinal dimension of said side wall at least equal to the thickness of said rear member, said flange having a height extending to the top of said side wall, and said flange having a laterally outward configuration adapted to the contour of said side wall.

2. The improvement claimed in claim 1, wherein said side walls comprise extruded members.

3. The improvement claimed in claim 2, wherein said side walls are formed of metal.

4. The improvement claimed in claim 3, wherein said metal is aluminum.

5. The improvement claimed in claim 1, wherein said roller carriers comprise die cast zinc members.

6. The improvement claimed in claim 1, wherein said projection of each said side wall comprises a lip fitting over the respective top edge of said bottom member, said lip having a rounded upper surface, and each said flange has a rounded lower edge complementary to and abutting said rounded upper surface of the respective said lip.

7. The improvement claimed in claim 1, wherein each said flange has a concave rounded forward edge.

8. The improvement claimed in claim 1, wherein each said roller carrier includes a rearwardly extending flange supporting the respective said roller.

9. The improvement claimed in claim 1, wherein each said roller carrier includes a laterally inwardly extending flange fastened to the rear surface of said rear member.

10. The improvement claimed in claim 9, wherein each said inwardly extending flange extends above the top of the respective said side wall and is connected to a respective drawer side rail.

11. The improvement claimed in claim 1, wherein each said roller carrier includes a laterally outwardly extending flange connected to and covering said rear end of the respective said side wall.

12. The improvement claimed in claim 11, wherein each said side wall is of double-wall construction.

* * * * *